United States Patent [19]

Abishev et al.

[11] 4,422,174

[45] Dec. 20, 1983

[54] SHAFT FURNACE FOR HEAT TREATMENT OF MATERIALS

[75] Inventors: Dzhantore N. Abishev; Vitaly P. Malyshev; Ivan K. Bauer, all of Karaganda; Vladimir A. Yarygin, Balkhash; Mikhail E. Maisakov, Balkhash; Garifulla K. Gainutdinov, Balkhash; Alexandr M. Nazarov, Balkhash; Temirkhan A. Kusainov, Karaganda; Isaak A. Burovoi, Moscow; Bulat N. Omarov, Karaganda, all of U.S.S.R.

[73] Assignee: Khimiko-metallurgichesky Institut AN Kazakhskoi SSR, Karaganda, U.S.S.R.

[21] Appl. No.: 269,018

[22] PCT Filed: Sep. 28, 1979

[86] PCT No.: PCT/SU79/00094

§ 371 Date: May 28, 1981

§ 102(e) Date: May 22, 1981

[87] PCT Pub. No.: WO81/00906

PCT Pub. Date: Apr. 2, 1981

[51] Int. Cl.[3] ..... H05B 3/00

[52] U.S. Cl. ..... 373/115; 432/95

[58] Field of Search ..... 373/109, 111, 115; 432/95, 101, 100

[56] References Cited

U.S. PATENT DOCUMENTS

| | | | |
|---|---|---|---|
| 2,108,118 | 2/1938 | Greenawalt | 373/115 X |
| 2,337,042 | 12/1943 | Gloss | 373/115 X |

FOREIGN PATENT DOCUMENTS

| | | | |
|---|---|---|---|
| 350113 | 12/1960 | Switzerland | 373/115 |
| 477302 | 3/1936 | United Kingdom | 373/109 |

*Primary Examiner*—Roy N. Envall, Jr.

*Attorney, Agent, or Firm*—Myron Greenspan; Burton L. Lilling; Bruce E. Lilling

[57] ABSTRACT

A shaft furnace comprises a body (2) made up of superimposed heated sections (3,4,5,6 and 7) each of which is provided with a tubular member (10,11,12,13 and 14) having its walls arranged at an angle of 3 to 4 deg. to the longitudinal axis of the furnace. The tubular members (10,11,12,13 and 14) are partially inserted one into another with a gap (15) formed therebetween; the opening area of the lower portion (16) of each tubular member (10–14) of each section (3–7) is 20 to 25 percent smaller than that of the upper portion (17) of the adjacent underlying tubular member (11) of the furnace section (4).

In the area of the gaps (15), the upper portions of the tubular members are formed with pockets (30) which are connected with outlet pipes (20) intended for discharging gaseous and vaporous fumes from the furnace shaft.

4 Claims, 2 Drawing Figures

SHAFT FURNACE FOR HEAT TREATMENT OF MATERIALS

FIELD OF THE INVENTION

The present invention relates to metallurgical and chemical industries, and more particularly, to a shaft furnace for heat treatment of materials.

The invention is readily adapted to application for drying and roasting without air access, of various powdered and pasty materials, such as flotation concentrates and slimes, as well as for driving off volatile and easily disintegrating substances, for instance, mercury, sulphur and flotation agents.

BACKGROUND OF THE INVENTION

In modern practice of heat treatment of powdered materials extensive use is made of multiple-hearth mechanical furnaces. This type of furnace generally comprises several superimposed annular hearths encased in a metallic cylindrical shell lined on the inside with a refractory material. To replace the material being treated from one hearth onto another, there is provided a power-driven cooled shaft formed with rabbles. A modern furnace may comprise up to 16 hearths. It is usually heated by furnace gases or else by burners, which are additionally mounted on some of the hearths. Gases are discharged from the furnace through an outlet pipe provided in the upper portion thereof.

This type of furnace is used for drying and firing lime, lime sludges, magnesite, as well as for oxidizing roasting of sulphide materials. Apart from being cumbersome, the furnace is rather complicated in construction and not sufficiently leak-proof, which is largely due to the presence of mechanical rabbling mechanism mounted within the furnace. Therefore, multiple-hearth mechanical furnaces are unsuitable for heat treatment of powdered or pasty materials without access of air.

Rotary-drum furnaces are now widely employed for sintering or roasting of pasty materials. The furnace of this type generally comprises an upright metallic shell lined on the inside with a refractory material. Burner and gas outlet heads are provided to make possible the furnace heating. To replace the material within the furnace, the latter is furnished with a rabbling mechanism mounted in the furnace interior. There are also provided fuel supply means and means intended to discharge the roasted material. The furnace construction is rendered very much complicated by sealings disposed at the places of connection of the furnace rotatable and fixed members.

The furnaces of the type described above are suitable for effecting sintering of pasty boxite and nepheline materials, as well as for oxidizing roasting of sulphide materials. It is practically impossible to make rotary-drum furnaces 100% leak-proof. Because of this such furnaces are never used for heat treatment of powdered or pasty materials without air access.

Moreover, the treatment of powdered materials in rotary and multiple-hearth furnaces is accompanied by the formation of immense amount of dust, which adversely affects reliability and durability of the furnace units and members.

It is common practice to use drum-type electric resistance furnaces where heat treatment of materials is conducted in the protective atmosphere. These furnaces are intended to perform heat treatment of non-sintering and other loose materials with no tendency to adhere to the furnace walls. Such furnaces are predominantly employed for the treatment of low-dust producing materials, this being important condition for setting up the circulation of an expensive inert gas.

However, the drum-type electric resistance furnaces are unsuitable for treatment of flotation concentrates, which are finely pulverized dust-forming materials. In addition, the heat treatment of flotation concentrates results in the precipitation of moisture, as well as in the separation of decomposition products obtained in the course of pyrolysis of flotation agents, and sulphur.

If heat treatment of finely dispersed dust-forming materials is effected in the protective atmosphere, use is made of furnaces intended for fluidized-bed roasting. The furnace of this type comprises a chamber with a bottom hearth through which heated compressed air is supplied to form fluidized bed of the material being treated. The most important feature of this furnace is its hearth formed as a plate from refractory concrete with multiplicity of holes protected by mushroom-like hozzles from the penetration of material. The roasted material is discharged from the furnace under its own weight through an outlet device disposed level with the fluidized bed.

These furnaces are employed for oxidizing, reducing, sulphidizing, chloride sublimation and other types of roasting of various concentrates and ores, as well as for drying granular, pasty and liquid materials.

However, these furnaces are disadvantageous in that a considerable loss on dust, at times as high as 50 percent of the initial material, is due to take place in the course of operation. As a result, the dust-collecting system, needed for the recovery of material entrained in as streams, is rendered extremely complicated and expensive. Furthermore, the recovered material should undergo secondary roasting in a muffle furnace to be followed by the recovery of valuable components therefrom.

Dust-collecting devices make the furnace much more complicated in construction and increase its operating cost. Because of this, the powdered material is granulated prior to being subjected to heat treatment in shaft furnaces. For example, there is known a shaft furnace, described in Japan Pat. No. 2803, which is used for heat treatment of granular materials in a flow of hot gas. This furnace is made up of superimposed sections each having gas inlet pipes and outlet pipes for discharging gaseous and vaporous fumes. The furnace has a downwardly flaring shaft. The charge for the furnace should be fed in lumps only, this being necessary condition for normal operation of the shaft furnace. Thus, a heat-carrying gas agent is permitted to pass through the layer of charge continuously descending in the shaft by gravity. If the furnace is charged with powdered or pasty materials, the passage of the heat-carrying agent through the charge is rendered impossible. The charge material will unavoidably stick to the furnace with the resultant clogging of gas ducts.

The present state of the ore-mining industry is characterized by an ever increasing proportion of polymetallic ores poor in valuable components. Needless to say that these ores require preliminary treatment, such as grinding and dressing. The resultant concentrates are pasty and wet powdered materials which require heat treatment (drying, roasting) in furnaces so as to be suitable for further use.

However, known furnaces fail to meet requirements for heat treatment of dispersed materials without air access; hence is the urgent need to introduce substantial improvements into conventional furnaces or else to provide a new type of furnace for similar purposes.

Great difficulties encountered on this way originate from the necessity to provide heat treatment to an ever increasing amount of pasty and wet powdered materials, which requires additional expences for auxiliary dust-collecting equipment, material rabbling mechanisms, furnace rotating devices or means for nodulizing dispersed materials.

In is therefore an object of this invention to obviate the above disadvantages.

DISCLOSURE OF THE INVENTION

What is required is a shaft furnace for heat treatment of materials, which will make it possible to effect the heat treatment of powdered and pasty materials without air access and protective atmosphere in a shaft furnace which is more simple in construction and reliable in operation, and to improve quality of the finished product.

The invention provides a shaft furnace for heat treatment of materials, comprising a housing made up of superimposed heated sections defining downwardly flaring shaft and provided with outlet pipes for gaseous and vaporous fumes to be discharged therethrough, wherein, according to theinvention, each section comprises a tubular member arranged along the longitudinal axis of the furnace and having its walls inclined at an angle of 3 to 4 deg. to the longitudinal axis of the furnace, the tubular members being partially inserted one into another with a gap provided therebetween, if being made possible by that the opening area of the lower portion of each inserted tubular member of the respective section is 20 to 25 percent smaller than the opening area of the upper portion of the neighbouring tubular member of the respective underlying section, the size of the opening area of the upper portion of the tubular member of the upper section ranging from 50×50 mm to 200×200 mm and the interior volume of the upper tubular member being 0.2 to 0.7 times that of the tubular member of the adjacent underlying furnace section, the outlet pipes for discharging gaseous and vaporous fumes being connected to pockets provided on the upper portion of each tubular member at the places of gaps.

Such furnace construction and appropriately selected dimensional relationship of its structural members permit heat treatment of nongranular powdered or pasty materials to be carried out without air access and protective atmosphere. The provision of tubular members, confining the flaringdown furnace shaft, ensures unhindered passage of the treated material from the charging place to the place where finished product is discharged. In addition, the provision of gaps between the tubular members facilitates displacement and rabbling of the material under tretment, and intensifies liberation of gaseous and vaporous fumes from the material being treated.

The afore-indicated dimensions of the interior volume of the upper section tubular member and proper relation between the opening areas of the upper section and other tubular members of successive sections provide for an appropriate length of the shaft, conducive to good process conditions.

With the tubular members being partially inserted one into another, the gaseous and vaporous fumes, which evolve in the process of treatment and settle on the walls of tubular members, are accumulated in the gaps formed therebetween. These fumes prevent the material being treated from sticking to the walls of the tubular members which define the furnace shaft, and are freely discharged through the outlet pipes connected to the pockets provided in the area of the gaps on the upper portions of the tubular members.

A decrease in the angle of inclination of the walls of each tubular member will impede the passage of the material under treatment, which will ring about the hanging-on of the material and its undue overheating. Any increase in this angle will adversely affect thermal performance of the furnace and thus will make it cumbersome and expensive.

With smaller sizes of the opening area and of the interior volume of the tubular member of the upper section it will be difficult to carry out the charging of pasty materials into the furnace. An increase in these sizes will adversely affect uniform heating of the incoming material and impede the escape of the gaseous and vaporous fumes liberating from the inner layers of the charge material. Furthermore, this may harmfully effect thermal conditions of all successive sections of the furnace with the resultant impaired quality of the finished product. Also, the cross sectional areas of all successive sections may be unduly increased, as well as overall dimensions of the furnace.

The interior of the tubular member of the lower section is preferably formed with a hollow partition intended to divide this inner space into two passages with the opening area of each being 0.5 to 0.7 times that of the lower portion of the tubular member of the superimposed adjacent section.

Such partition allows better heating of the intermediate layers of the treated material and complete liberation of gaseous and vaporous fumes therefrom.

An increase in the number of passages with smaller opening area will complicate discharging of the finished product and, as a consequence, will involve higher expences for unjustified structural changes.

Each section and vertical partition is preferably provided with a resistance heater fittingly mounted therein.

The provision of individual resistance heaters in the above-mentioned places of the furnace makes it possible to maintain a requisite temperature at this areas and to replace them whenever necessary. The resistance heaters are sufficiently space-saving and are positioned externally of the furnace shaft.

It is advantageous to provide a chamber for cooling the material, which is preferably located under the lower section of the furnace and furnished with a vertical driven shaft having vanes fixed thereto along helical line.

The cooling of the finished product will prevent its oxidation and make possible appropriate utilization of heat. In addition, by loosening and stirring the finished product, it becomes possible to make homogeneous in chemical composition, as well as to attain uniformity in moisture and temperature.

BRIEF DESCRIPTION OF THE DRAWINGS

The invention will be now explained, by way of example only, with reference to the accompanying drawings, wherein.

BEST MODE OF CARRYING OUT THE INVENTION

Figure 1:
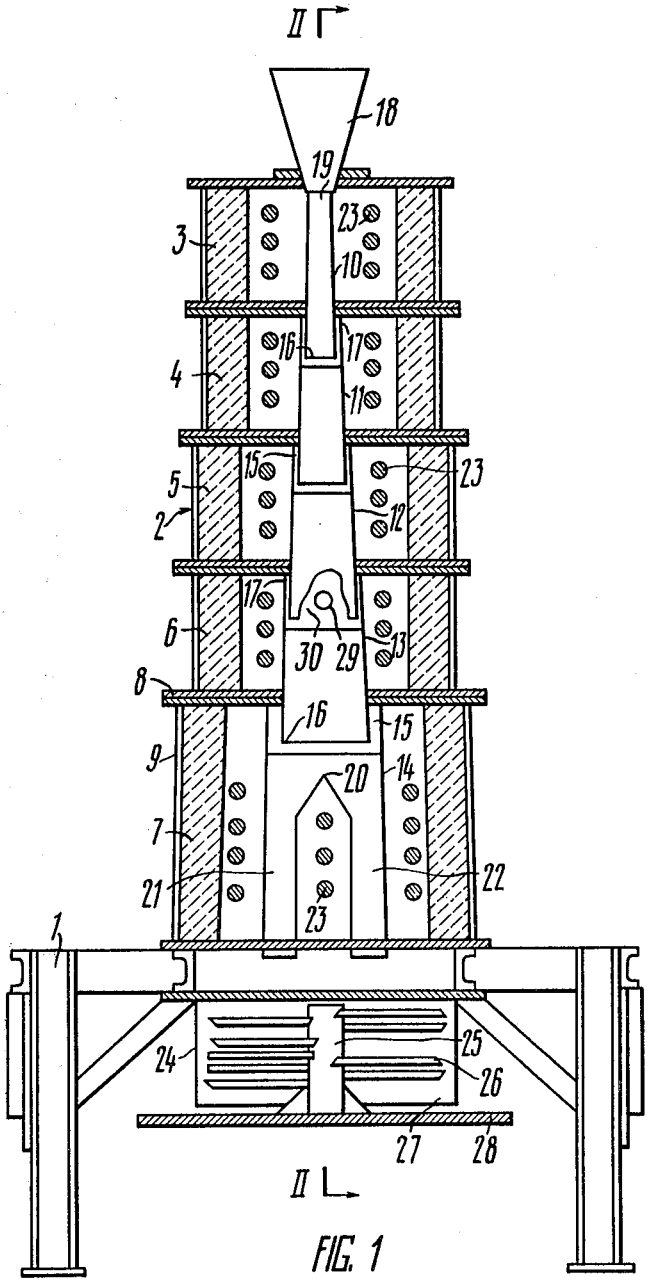
FIG. 1 is a vertical sectional view of a shaft furnace according to the invention.
Figure 2:
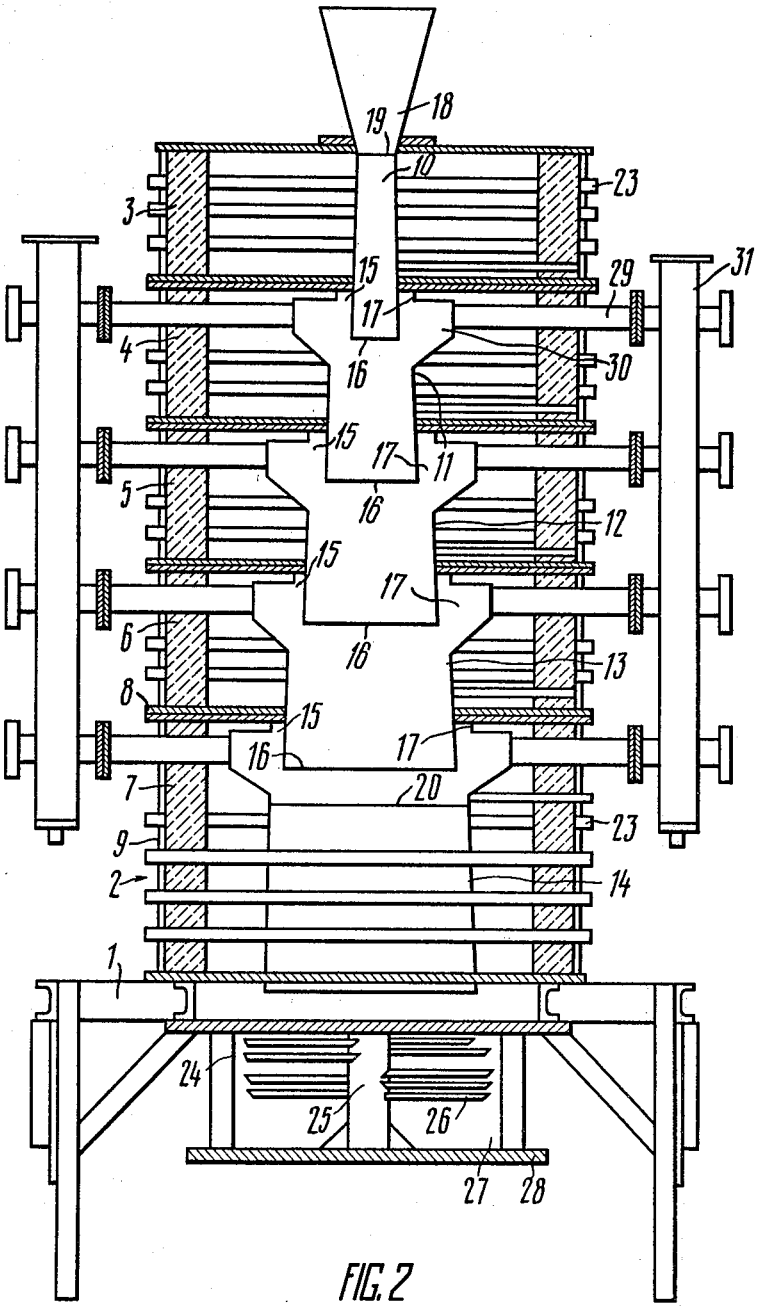
FIG. 2 is a cross section along line II—II of FIG. 1.

The illustrated shaft furnace for heat treatment of material is mounted on a metal frame 1 (FIGS. 1 and 2) and comprises a body or housing 2 made up of superimposed heated sections 3, 4, 5, 6 and 7 formed of refractory material. The sections are fixed one to another by means of metal plates 8 and metal angle brackets 9 supporting the brickwork of each section of the furnace. Each of the furnace sections 3, 4, 5, 6 and 7 has a tubular member 10, 11, 12, 13 and 14 arranged along the longitudinal axis of the furnace and formed of refractory metal or concrete. The walls of each tubular member 10, 11, 12, 13 and 14 are inclined at angle of 3 to 4 deg. to the furnace longitudinal axis, with their width being calculated by the following formula: $\delta=\sqrt{h}+200$ mm, where h is the length of the tubular member in mm. The tubular members 10, 11, 12, 13 and 14 are partially inserted one into another with a gap 15 formed therebetween due to the fact that the opening area of a lower portion 16 of each inserted tubular member 10, 11, 12 and 13 of the respective sections 3, 4, 5 and 6 is 20 to 25 percent smaller than an upper section 17 of the adajcent tubular member 11, 12, 13 and 14 of the respective underlying section 4, 5, 6 and 7. The angles of inclination of the walls of the tubular members and the gaps 15 between the respective portions of the tubular members 10, 11, 12, 13 and 14 make for the downward flaring of the shaft furnace.

The upper section 3 of the furnace is furnished with a funnel-shaped feed appliance 18. The size of the opening area of an upper portion 19 of the tubular member 10 of the furnace upper section 3 ranges 50×10 mm to 200×200 mm, with the interior volume of the upper tubular member 10 being 0.2 to 0.7 times that of the tubular member 11 of the underlying adjacent furnace section 4.

Formed in the interior of the tubular member 14 of the lower section 7 is a vertical hollow partition 20 which divides the interior space into two passages 21 and 22. The cross sectional area of each of the two passages is 0.5 to 0.7 times that of the lower portion 16 of the tubular member 13 of the overlying adjacent section 6. Each of the furnace sections 3, 4, 5, 6 and 7 and the vertical partition 20 are furnished with resistance heaters 23.

Mounted under the furnace lower section 7 is a chamber 24 intended for cooling the finished product. Located in the chamber 24 is a vertical driven shaft 25 with vanes 26 fixed thereto along helical line. Positioned below a discharge opening 27 of the furnace is a disk feeder 28. The gaseous and vaporous fumes liberating from the charge material are allowed to escape from the tubular members 11, 12, 13 and 14 of the furnace sections 4, 5, 6 and 7 through outlet pipes 29 connected with pockets 30 provided in the area of the gaps 15 on the upper portions 17 of the tubular members 11, 12, 13 and 14. The outlet pipes 29 are brought in communication with manifolds 31 through which gaseous and vaporous fumes are discharged from the furnace shaft.

The shaft furnace according to the invention for heat treatment of materials operates in the following manner.

A powdered or pasty material is fed from the funnel-shaped charging appliance 18 to the tubular member 10 of the upper section 3 and descends by gravity along the furnace shaft defined by the tubular members 11, 12, 13 and 14 of the furnace sections 4, 5, 6 and 7. The temperature of the walls of the tubular members 10, 11, 12 and 13 is by 100° to 200° higher than the boiling temperature of the gaseous and vaporous fumes escaping from the material under treatment found in the given section, and is controlled individually by means of the resistance heaters 23. Since the walls of the tubular members are inclined at an angle of 3 to 4 deg. to the longitudinal axis of the furnace, the gaseous and vaporous fumes, escaping from the heated material, create head pressure along the walls. Thus, the sticking of the material to the walls is ruled out and downward movement of the material along the shaft furnace is facilitated.

Next, the material being treated passes into the tubular member 14 of the lower section 7 wherein it is divided by means of the vertical partition 20 into two streams travelling along the passages 21 and 22. As this happens, the resistance heaters 23, mounted in the partition 20, are brought into operation to subject the treated material to additional heating. This is done to remove the residual amount of gaseous and vaporous fumes from the material and direct them to the gaps 15. From the passages 21 and 22, the material being treated is fed to the cooling chamber 24 wherein it is engaged by the vanes 26 of the vertical shaft 25 and is thus loosened in the course of its rotation. As a result, the material is made uniform as regards its chemical composition and temperature, and the overheated material is prevented from passing to the disk feeder 28 provided for the delivery of the finished product.

The gaseous and vaporous fumes, escaping from the treated material accumulate in the gaps 15 provided between the tubular members 10 and 11, 11 and 12, 12 and 13, 13 and 14 of the furnace sections 3, 4, 5, 6 and 7. On leaving the gaps 15, the fumes proceed to the pockets 30 and from there are passed under pressure along the pipes 29 to the manifold 31. the heat pressure created by the gaseous and vaporous fumes from below and the layer of the treated material from above prevent the air from penetrating into the furnace shaft in the course of its operation.

INDUSTRIAL APPLICABILITY

The shaft furnace of the invention has been tested to show excellent performance characteristics. The material used was copper electrolyte slime, molybdenum and tungsten products. The furnace was used for drying pasty molybdenum product with the total content of moisture and flotation oils amounting 30 percent. The temperature in the furnace sections was the following: 200° C. in the first section, 300° in the second, 400° in the third and fourth sections, and 300° in the fifth section. The resultant finished product contained 4% moisture and 2% flotation oils.

Powdered tungsten concentrate, containing 67.97% tungsten trioxide and 7.09% sulphur, was subjected to heat treatment in the furnace of the invention with the purpose of removing pyrite sulphur therefrom. The temperature in the first section was 450° C., in the second and third sections—700° C., and in the fourth and fifth sections it was 850° C. The heat-treated concentrate contained 72.05% tungsten trioxide and 0.68% sulphur, which substantially improved its quality.

Therefore, the shaft furnace of the invention has been found to have extensive field of application, since it is suitable for heat treatment of various materials, be it granular or pasty. The furnace exhibits high operating efficiency, low power input, markedly improved quality of the finished product. All the operations associated with heat treatment of materials can be easily mechanized and automated in these furnaces.

What is claimed is:

1. A shaft furnace for heat treatment of material comprising:

a housing having a plurality of heating sections arranged in series over the vertical extent of the furnace, an upper section of said heating sections being arranged in the upper part of the furnace;

a downwardly flaring furnace shaft arranged within said housing;

tubular members arranged one in each of said sections along the longitudinal axis of said furnace, said tubular members having walls inclined at an angle of 3° to 4° to the longitudinal axis of said furnace, said tubular members forming interior spaces therebetween and having upper and lower portions, said tubular members having passages in said upper and lower sections, the flow areas of said passages of the lower portions of said tubular members of each of said sections being 20 to 25 percent smaller than the flow areas of said passages of the upper parts of the tubular members of the adjacent underlying sections, said lower portion of the tubular member in each of said sections being partially inserted into said upper portion of the tubular member of the adjacent underlying section, said lower and upper portions of the tubular members of said adjacent sections forming a gap, the size of said passage in the upper portion of the tubular member of said upper section ranging from 50×50 mm to 200×200 mm, the volume of said interior space of the tubular member of said upper section being 0.2 to 0.7 times that of the interior space of the tubular member of said adjacent underlying section;

pockets provided in said upper portions of each of said tubular members; and outlet pipes for discharging gaseous and vaporous fumes, said outlet pipes being connected with said pockets.

2. A shaft furnace as claimed in claim 1, further comprising:

a vertical partition dividing the interior space of said tubular member of said lower section into two passages each defining a flow area, the size of the flow area of each of said passages in the tubular member of said lower section ranging from 0.5 to 0.7 times the size of the flow area of said lower portion of the tubular member of the underlying section.

3. A shaft furnace as claimed in claim 1, further comprising:

a material cooling chamber arranged below said lower section;

a vertical shaft accommodated in said cooling chamber;

vanes secured on said vertical shaft, said vanes being arranged along a helical line.

4. A shaft furnace as claimed in claim 2, wherein:

said heated sections have walls; and further comprising resistance heaters built in the walls of said sections and in said vertical partition.

* * * * *